US006612277B2

(12) United States Patent
Genise

(10) Patent No.: US 6,612,277 B2
(45) Date of Patent: Sep. 2, 2003

(54) VALVE TRAIN ASSEMBLY

(75) Inventor: David G. Genise, Turin (IT)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/164,911

(22) Filed: Jun. 7, 2002

(65) Prior Publication Data

US 2003/0010305 A1 Jan. 16, 2003

(30) Foreign Application Priority Data

Jun. 15, 2001 (EP) ..... 1830398

(51) Int. Cl.[7] ..... F01L 1/18

(52) U.S. Cl. ..... 123/90.45; 123/90.43; 123/90.46; 123/90.16

(58) Field of Search ..... 123/90.6, 90.15–90.18, 123/90.37–90.46

(56) References Cited

U.S. PATENT DOCUMENTS 5,659,873 A * 8/1997 Seyrkammer ..... 419/29
5,660,153 A * 8/1997 Hampton et al. ..... 123/90.16
5,819,694 A * 10/1998 Trutescu et al. ..... 123/90.43
6,314,928 B1 * 11/2001 Baraszu et al. ..... 123/90.16

* cited by examiner

*Primary Examiner*—Thomas Denion
*Assistant Examiner*—Kyle Riddle
(74) *Attorney, Agent, or Firm*—L. J. Kasper

(57) ABSTRACT

A rocker arm assembly for a valve train includes a hydraulic lash adjuster for accommodating slack in the valve train. There is also a lost-motion connection preferably between the axle of a roller which is operated upon by a cam and the rocker arm itself. Excessive expansion of the lash adjuster will not prevent closing of the valve because the closing movement is accommodated by the lost-motion connection. A spring is provided to maintain the lost-motion connection despite the tendency of the hydraulic lash adjuster to expand. Greater tolerance in the cam base circle radius is allowed, permitting the use of net-shaped cams.

13 Claims, 5 Drawing Sheets

PRIOR ART

VALVE TRAIN ASSEMBLY

BACKGROUND OF THE DISCLOSURE

This invention relates to valve train assemblies, and particularly but not exclusively to assemblies which incorporate a rocker arm pivoted by a cam in order to operate a valve.

A typical structure of this type is shown schematically in FIG. 1. The valve train assembly 2 comprises the rocker arm 4 and a hydraulic lash adjuster 6. One end 8 of the rocker arm 4 engages the stem 10 of a valve 11. The other end 12 of the rocker arm is mounted for pivotal movement on the lash adjuster 6.

The rocker arm 4 is provided with a roller 14 mounted on an axle 16 carried by the rocker arm 4.

A cam 18 mounted on a cam shaft 15 has a lobe 17 which can engage the roller 14 and thus pivot the rocker arm 4 counterclockwise as shown in the drawing. This depresses the valve stem 10 against the force of a valve spring (not shown) and thus opens the valve. As the cam continues to rotate, and the base circle 19 of the cam profile again engages the roller 14, the valve spring returns the valve and the rocker arm 4 to the position shown in FIG. 1.

As is well known, a hydraulic lash adjuster has an oil-containing chamber and a spring arranged to enlarge the chamber and thus extend the lash adjuster. Oil flows into the chamber via a one-way valve, but can escape the chamber only slowly, for example via closely-spaced leakdown surfaces.

Accordingly, the lash adjuster 6 of FIG. 1 can extend to accommodate any slack in the valve train assembly, such as between the cam 18 and the roller 14. After it is extended, however, the oil-filled chamber provides sufficient support for the pivoting movement of the rocker arm 4.

It is important for the base circle 19 of the cam 18 to be concentric with respect to the axis of rotation of the cam shaft 15. Any slight eccentricity ("run-out") could cause the valve to close later than it should, or open during the movement of the base circle past the roller 14. The cam 18 is often formed by sintering and may not have, in its initial state, particularly accurate dimensions. Accordingly, it is conventional, before assembly, to grind either the outer surface, including the base circle 19, of the cam 18, or to grind the inner diameter which is fitted to the cam shaft 15, to ensure accurate concentricity of the base circle 19 relative to the axis of rotation of the cam shaft 15.

Although the arrangement described above works well during normal running conditions, problems can arise in certain circumstances. For example, in order to prevent problems when starting the engine from cold, it has been proposed to use a technique whereby the valves and cylinder head are caused to heat up very quickly. Referring to FIG. 2, the rapid heating of the head 23 of the valve 11 causes the head 23 to expand relative to the valve seat 21. This expansion results in the valve moving downwardly against the force of the valve spring, as shown on the right of FIG. 2. This process creates positive lash, which is accommodated by expansion of the hydraulic adjuster as the camshaft rotates. However, as the cylinder head 25 and the valve seat 21 then heat up, their expansion allows the valve 11 to move back upwardly, thus creating negative lash (which will be subsequently exacerbated due to expansion of the valve stem 10). This negative lash can be accommodated by shrinking of the lash adjuster. However, because the heating process is taking place rapidly, and the shortening of the lash adjuster is limited by the rate of leakage of oil from the high pressure chamber, the lash adjuster does not shorten sufficiently quickly. This problem is exacerbated because the oil is still cold and therefore viscous, thus reducing the leakage rate. This results in valves remaining open (shown in dotted lines in FIG. 1), causing starting problems.

There have been proposed valve trains which provide "lift loss", that is, in which the initial movement caused by the cam is absorbed before further movement is transmitted to the valve. See for example U.S. Pat. Nos. 6,039,017 and 6,170,450. Thus, there is a degree of lost motion in the valve train before the valve starts to open. This lost motion is recovered by a spring after the valve has closed. Using such an arrangement, a small degree of negative lash can be quickly accommodated by the lost motion, thus making it more certain that the valve will close.

It would be desirable to provide an improved arrangement for providing lift loss, and also to provide a valve train which can be manufactured more easily.

BRIEF SUMMARY OF THE INVENTION

Aspects of the present invention are set out in the accompanying claims.

According to one aspect of the invention, a valve train assembly includes a rocker arm supporting a cam-engaging roller, wherein the roller, instead of having a rotation axis fixed with respect to the rocker arm, has an axis which is allowed to shift slightly against the force of a resilient biasing means, thereby providing lift loss when operating the valve, and thus accommodating movement of the valve towards its closing position in circumstances in which a lash adjuster has extended excessively.

In the preferred embodiment, the resilient biasing means, or spring, is strong enough to prevent the lash adjuster from taking up the lost-motion connection in the valve train. As the lobe on the cam starts to operate on the valve train, the lost-motion connection permits such movement to occur, without operating the valve, against the force of the spring. After the lost-motion has been taken up, the valve is operated. Subsequently, as the cam continues to rotate, the valve moves towards its closing position. After the valve is closed, the lost-motion connection is restored by the biasing means. Closing of the valve is thus guaranteed, because any required additional movement is accommodated by the lost-motion connection.

According to another aspect of the invention, it has been perceived that a lost motion connection such as that set out above means that the base circle radius variation of the cam no longer has to be minimized by grinding, allowing the use of net-shaped cam shaft technology instead of more expensive ground cams. (The term net-shaped is generally understood, and used herein, in the sense of having a shape and dimensions which are at least substantially the same as those resulting from the initial forming of the object. This does not exclude the possibility of small changes in dimensions which are a consequence of, for example, surface-treatment for the purpose of smoothing, as distinct from dimensional changes (e.g. by grinding) for the purpose of altering the function performed as a result of those dimensions. The initial forming may, but is not necessarily, achieved by sintering.)

The invention will be described in the context of an arrangement in which the valve assembly comprises a rocker arm pivoted at one end on the lash adjuster, with the other end operating the valve stem. However, some aspects of the invention can also be embodied in other types of arrangements, such as center-pivoted rocker arms, and indeed could be applied to arrangements which don't include a rocker arm, such as direct-acting tappets (see U.S. Pat. No. 6,170,450), so long as the requisite lost motion connection is provided.

DETAILED DESCRIPTION OF THE PREFERRED EMBODIMENT

Figure 3:
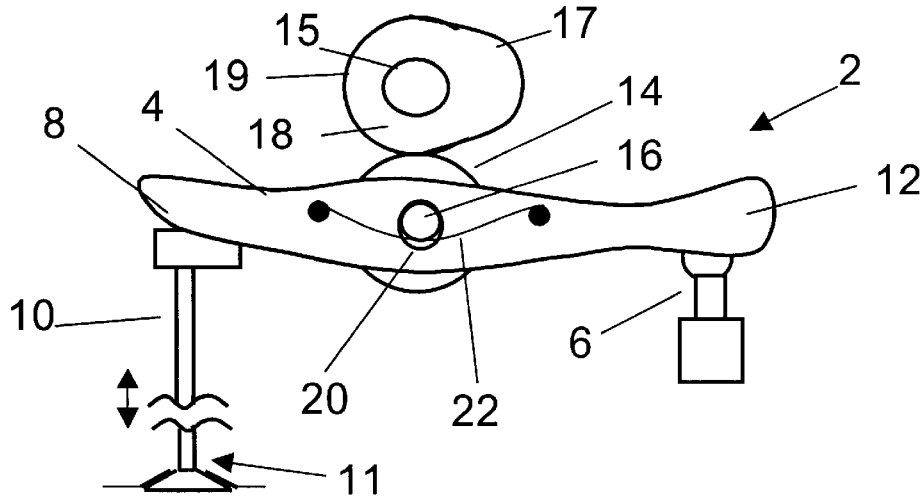
FIGS. 3 and 4 schematically show a valve train assembly in accordance with the present invention in respective states.

Referring to FIG. 3, the valve train assembly 2 shown here is similar to that of FIG. 1 (and like reference numbers designate like elements) except in respect of the differences explained below.

Figure 1:
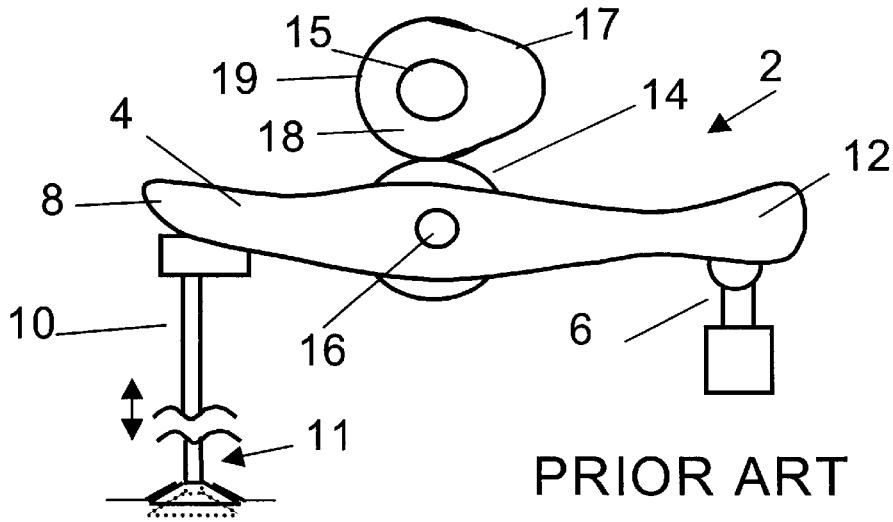
FIG. 1 schematically shows a conventional valve train assembly.
Figure 2:
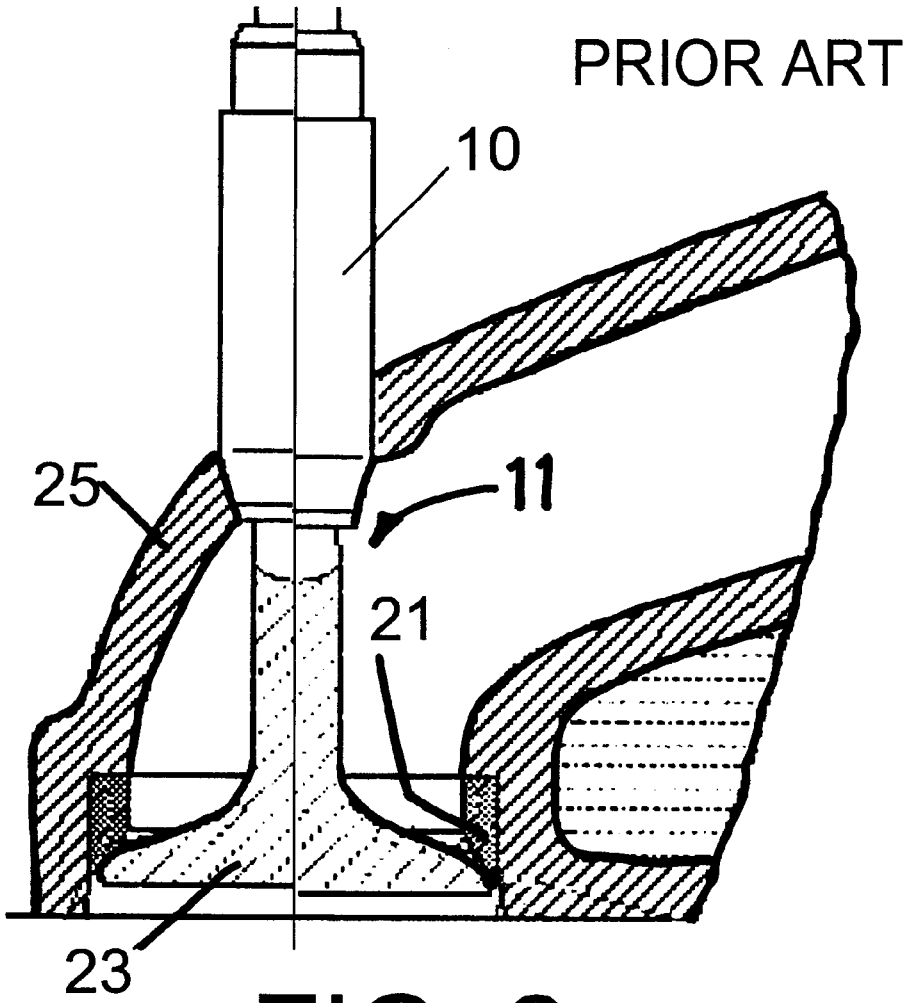
FIG. 2 illustrates differential expansion of engine components in an engine of known type.

The cam 18 of FIG. 3 looks similar to that of FIG. 1, and has also been formed by a sintering operation (but could alternatively be formed by other means, such as hydroforming or hot- or cold-forming). However, in this case, no additional grinding operation has been performed on either the outer surface of the base circle 19 or on the inner surface of the cam. Accordingly, the cam 18 is net-shaped and the base circle 19 is not necessarily accurately concentric with respect to the axis of rotation. (It may be desirable in some embodiments, such as alternatives which incorporate direct-acting cams, to have a surface treatment for the purpose of smoothing the exterior of the cam.)

In the arrangement of FIG. 3, the axle 16 of the roller 14 is mounted and movable within an over-size hole, or aperture, 20 in the rocker arm 4, forming a lost-motion connection. A spring 22 operates on the axle 16 so as to bias it towards the top of the hole 20.

In operation, when the cam lobe engages the roller 14, the axle 16 is forced downwardly within the hole 20 against the bias of the spring 22. Accordingly, the rocker arm 4 is not pivoted by the cam until the axle 16 engages the bottom of the hole 20, after which the valve stem 10 is moved. After the cam lobe 17 has passed and the base circle 19 is approached, the valve closes and then the axle 16 moves back to the top of the hole 20 under the force of the spring 22. This operation repeats as the cam rotates, the axle 16 always engaging the bottom of the hole 20 before the valve opens.

On start-up, the hydraulic lash adjuster 6 rapidly receives oil under pressure and expands to take up any slack in the valve train. However, as explained previously, subsequent expansion of the engine components may result in the requirement for the lash adjuster to contract in order to permit closing of the valve. In prior art arrangements, this cannot occur quickly because the oil has to flow between leak-down surfaces, and the flow is thus slow, especially after start-up when the oil is still cold.

Figure 4:
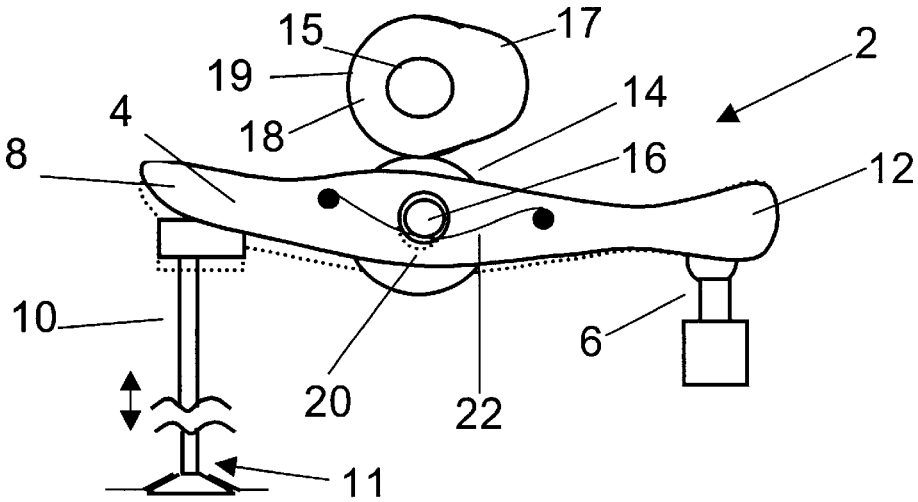

In the present embodiment, however, the valve is still capable of being closed by the valve spring, because any additional movement required of the rocker arm is accommodated by the lost-motion connection. Thus, the difference in desired versus actual lash adjuster position is taken up by the axle 16 not completely returning to the top portion of the hole 20. FIG. 4 illustrates that the rocker arm 4 can move from the dotted line position, which would preclude closing of the valve, to the solid line position which permits valve closing, by taking up some of the lost motion.

If at a later stage there is a tendency for an increased amount of slack in the valve train, the axle 16 will first tend to move back towards the top of the hole 20 due to the force of the spring 22 before any additional slack is taken up by expansion of the lash adjuster 6.

To achieve correct operation, the spring 22 is specified so that the force it applies to the valve stem when it is fully extended is less than the pre-load force of the valve spring in the closed position. This ensures that the valve spring is sufficiently powerful to close the valve against the force produced by the spring 22. Also, the pre-load force of the spring 22 is calculated to be greater than the sum of the lash adjuster return spring and the oil pressure forces in the lash adjuster. In other words, the spring 22 is sufficiently powerful to prevent the lash adjuster 6 from expanding to take up the lost motion between the axle 16 and the hole 20.

Because of the arrangement described above, any non-concentricity (run-out) of the base circle 19 (which in the FIG. 1 arrangement would result in the valve being open during engagement of the base circle with the roller 14) will be accommodated by the lost motion connection, thus avoiding false opening.

Figure 5:
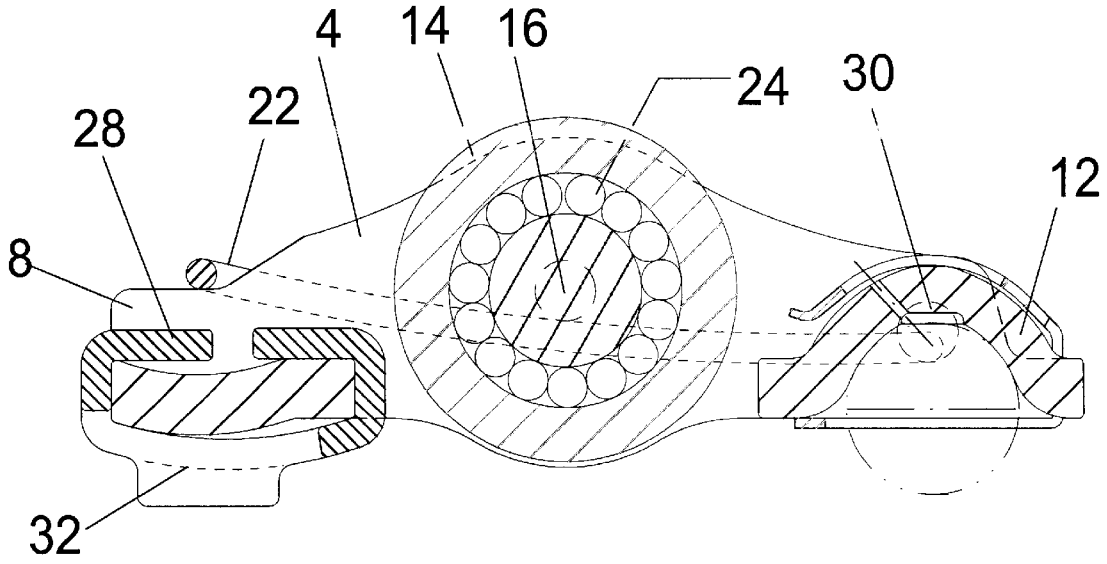
FIG. 5 is a side view, partly in section, of a rocker arm of a valve train assembly in accordance with a further embodiment of the invention.
Figure 6:
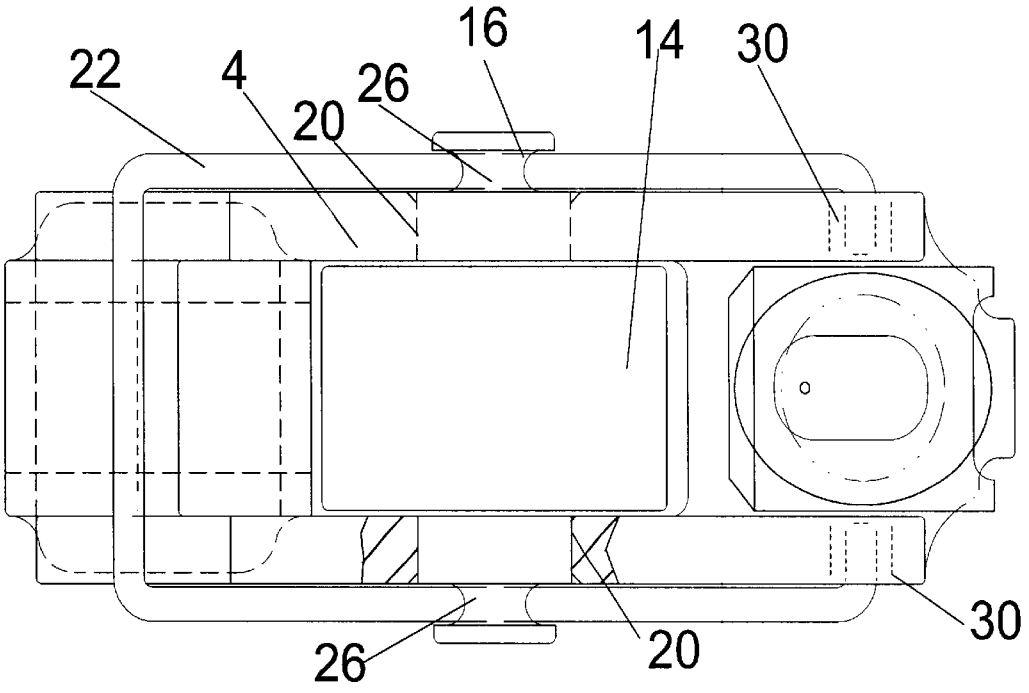
FIG. 6 is a plan view of the rocker arm of FIG. 5.

A practical embodiment of the rocker arm is shown in FIGS. 5 and 6. The rocker arm is made of stamped sheet metal and has a part-spherical end 12 to permit pivoting about a part-spherical end of the lash adjuster 6. The roller 14 is mounted on needle bearings 24 and supported on the axle 16. The axle 16 is supported in holes 20 in respective side walls of the rocker arm 4, at least one and preferably both of the holes being oversized to permit lateral movement of the axle. The axle 16 has circumferential grooves 26 at respective ends.

The end 8 of the rocker arm carries a member 28 having a surface 32 for engaging the end of the valve stem.

The spring 22 is generally U-shaped, having a central portion which locates over the end 8 of the rocker arm 4 and two arms which extend along the sides of the rocker arm, under the axle 16 and in the recesses 26 thereof. The arms have ends which locate in the apertures 30 of the rocker arm 4 at the end 12 thereof. The arms of the spring could instead extend through holes drilled through the axle 16.

Figure 7:
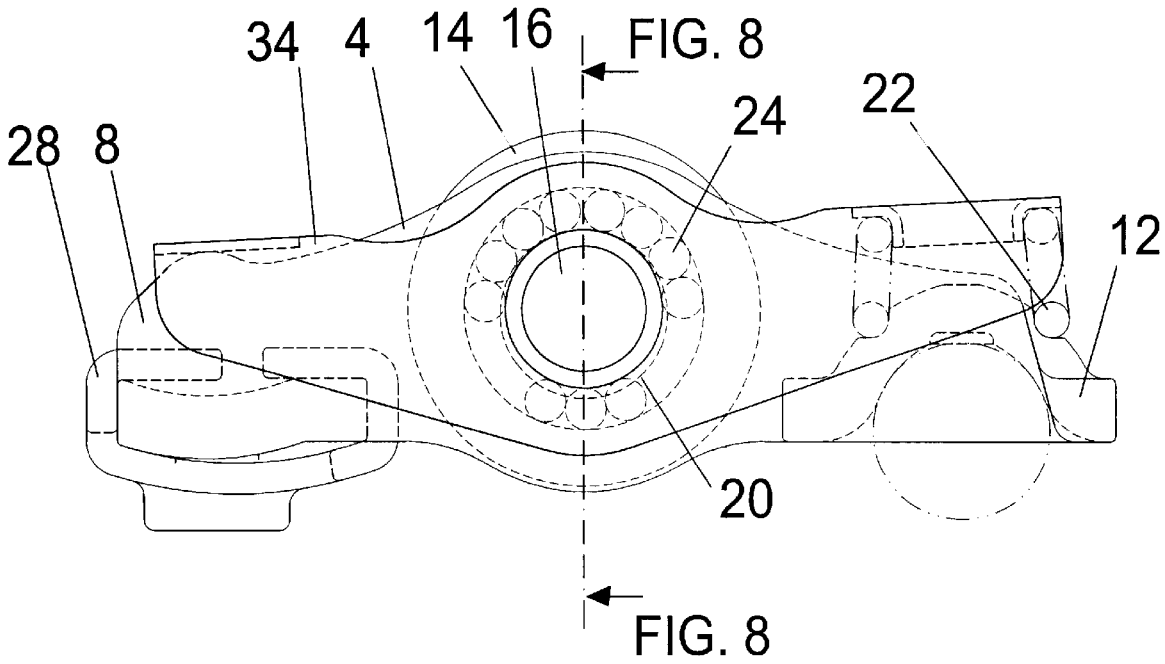
FIG. 7 is a side view of a rocker arm of a valve train assembly in accordance with a further embodiment of the invention.
Figure 8:
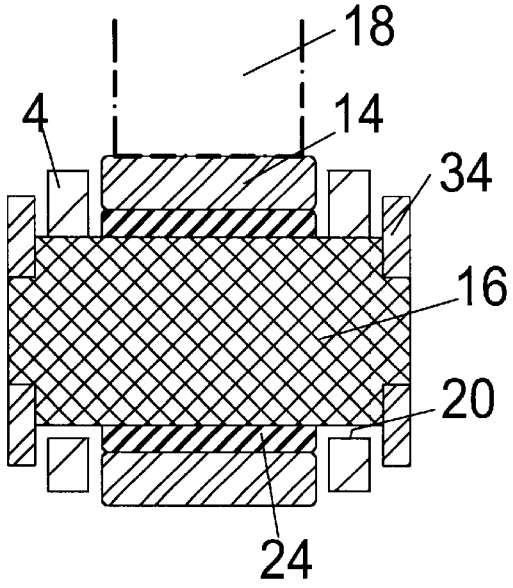
FIG. 8 is a cross-sectional view of the rocker arm of FIG. 7.

FIGS. 7 and 8 show an alternative arrangement. Here, the axle 16 of the roller 14 is tightly supported by the sides of a retainer 34 formed of stamped sheet metal with its sides fitted over and surrounding the rocker arm 4. The axle again extends through over-sized holes 20 in the rocker arm 4. The retainer 34 engages the rocker arm 4 at the end 8 thereof. The opposite end of the retainer 34 is located over but biased away from the part-spherical end 12 of the rocker arm 4, by means of a conical spring 22. Thus, the entire retainer 34 and the supported roller 14 and axle 16 are pivoted counter-clockwise by the force of the spring 22 such that, as in the earlier embodiments, the axle 16 is biased towards the top of the holes 20.

In all the arrangements described above, because of the lost-motion connection, the valve opens later and closes sooner, in relation to the rotation of the cam, than in prior art arrangements. In order to compensate, the profile of the cam is altered as compared with prior art arrangements. A further alteration to the profile is made in order to extend the ramp of the cam lobe to ensure that the axle 16 makes contact with the rocker arm 4 at a controlled velocity, rather than during the high-acceleration portion of the opening event. This reduces the impact force of the axle 16 against the rocker arm 4.

In the above embodiments, the sizes of the holes 20 define the maximum amount lost motion, and thus the maximum amount of lift loss. The maximum amount of lift loss, as measured at any given location, should: (a) equal or exceed the maximum amount of negative lash created by the differential thermal expansion of the various engine components, plus, if a net-shaped cam is used, the lash created by the maximum expected amount of run-out of the base circle, i.e. the maximum amount by which the base circle radius varies; and (b) be less than the amount which would cause excessive valve closure speeds. (It will be appreciated that provision of lift loss means that valve opening and closing will take place over a smaller arc of cam rotation, and thus at increased speed.)

In one preferred embodiment the sizes of the holes 20 are such as to provide lost motion of the axle 16 in the range of 0.1 mm to 0.3 mm, and more preferably in the range 0.15 mm to 0.25 mm.

The holes 20 may be oval-shaped or circular. If oval-shaped, each end radius is preferably substantially the same as the radius of the axle 16, the end radii being offset by the amount of the desired lost motion.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve train assembly comprising a rocker arm which has a roller for engaging a cam whereby the rocker arm can be pivoted by the cam to operate a valve, and a hydraulic lash adjuster to take up slack in the valve train, wherein the axis of rotation of the roller is movable against the force of a biasing means relative to the rocker arm to provide a lost-motion connection permitting movement of the rocker arm in such a manner as to accommodate a greater degree of movement of the valve towards its closing position than permitted by the movement of the cam.

2. An assembly as claimed in claim 1, wherein the roller is provided on an axle, the axis of which is movable relative to the rocker arm.

3. An assembly as claimed in claim 2, wherein the axle is supported by an aperture in the rocker arm, the aperture being sized to permit transverse movement of the axle therein.

4. An assembly as claimed in claim 2, wherein the biasing means comprises a spring engaging the rocker arm and the axle.

5. An assembly as claimed in claim 1, including a retainer carrying the roller, the retainer being supported at one end by the rocker arm and, at the other end, being biased away from the rocker arm by the biasing means.

6. An assembly as claimed in claim 1, wherein the rocker arm is pivoted at one end about the lash adjuster and is arranged so that the other end operates the valve under a force applied between said ends by the cam.

7. An assembly as claimed in claim 1, wherein the minimum force applied by the biasing means is sufficient to prevent expansion of the hydraulic lash adjuster.

8. An assembly as claimed in claim 1, further comprising a non-ground cam arranged to engage said roller to operate said valve.

9. An assembly as claimed in claim 8, wherein the cam is substantially net-shaped.

10. A valve train assembly for operating a valve, of an internal combustion engine, the assembly comprising a valve train assembly including said valve, and further comprising a non-ground cam arranged to cause the valve to open and close and a hydraulic lash adjuster which can expand to take up slack in the train between the cam and the valve, the assembly incorporating a lost-motion connection so arranged that the lost motion of the connection has to be taken up before the valve is operated, and biasing means for restoring the lost motion connection, whereby the lost motion connection can accommodate movement of the valve towards its closing position.

11. An assembly as claimed in claim 10, wherein the cam is substantially net-shaped.

12. An assembly as claimed in claim 10, wherein the minimum force applied by the biasing means is sufficient to prevent expansion of the hydraulic lash adjuster.

13. A valve assembly as claimed in claim 11, including a valve spring for closing the valve, the force of the valve spring being, at its minimum, greater than the maximum force exerted by said biasing means so as to ensure closing of the valve.

* * * * *